US006348898B1

(12) United States Patent
Rosenbury et al.

(10) Patent No.: US 6,348,898 B1
(45) Date of Patent: Feb. 19, 2002

(54) LOW COST IMPULSE COMPATIBLE WIDEBAND ANTENNA

(75) Inventors: Erwin T. Rosenbury; Gerald J. Burke, both of Livermore; Scott D. Nelson, Tracy; Robert D. Stever, Lathrop; George K. Governo; Donald J. Mullenhoff, both of Livermore, all of CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 09/340,178

(22) Filed: Jun. 25, 1999

Related U.S. Application Data

(60) Provisional application No. 60/090,897, filed on Jun. 25, 1998.

(51) Int. Cl.[7] ..... H01Q 13/00

(52) U.S. Cl. ..... 343/786; 343/772; 343/795

(58) Field of Search ..... 343/786, 767, 343/772, 795, 829, 830, 846; H01Q 13/00

(56) References Cited

U.S. PATENT DOCUMENTS

| | | | | | |
|---|---|---|---|---|---|
| 3,534,376 | A | * | 10/1970 | Webb | 343/786 |
| 4,630,062 | A | | 12/1986 | Dewey | 343/786 |
| 4,994,818 | A | * | 2/1991 | Keilmann | 343/785 |
| 5,363,108 | A | | 11/1994 | Fullerton | 342/27 |
| 5,406,298 | A | * | 4/1995 | Walters | 343/786 |
| 5,440,316 | A | * | 8/1995 | Podgorski et al. | 343/786 |
| 5,471,223 | A | | 11/1995 | McCorkle | 343/786 |
| 5,754,144 | A | | 5/1998 | McEwan | 343/786 |
| 5,764,696 | A | | 6/1998 | Barnes et al. | 375/239 |
| 5,973,653 | A | * | 10/1999 | Kragalott et al. | 343/786 |

FOREIGN PATENT DOCUMENTS

| | | |
|---|---|---|
| GB | 2173646 | 10/1986 |
| WO | WO 9807209 | 2/1998 |

* cited by examiner

*Primary Examiner*—Hoanganh Le
(74) *Attorney, Agent, or Firm*—L. E. Carnahan; Alan H. Thompson

(57) ABSTRACT

An antenna apparatus and method for building the antenna is disclosed. Impulse signals travel through a feed point of the antenna with respect to a ground plane. A geometric fin structure is connected to the feed point, and through a termination resistance to the ground plane. A geometric ridge structure connected to the ground is positioned with respect to the fin in order to receive and radiate electromagnetic energy from the impulse signal at a predetermined impedance and over a predetermined set of frequencies. The fin and ridge can be either a wire or a planar surface. The fin and ridge may be disposed within a radiation cavity such as a horn. The radiation cavity is constructed of stamped and etched metal sheets bent and then soldered together. The fin and ridge are also formed from metal sheets or wires. The fin is attached to the feed point and then to the cavity through a termination resistance. The ridge is attached to the cavity and disposed with respect to the fin in order to achieve a particular set of antenna characteristics.

25 Claims, 4 Drawing Sheets

LOW COST IMPULSE COMPATIBLE WIDEBAND ANTENNA

REFERENCE TO PROVISIONAL APPLICATION TO CLAIM PRIORITY

A priority date for this present U.S. patent application has been established by prior U.S. Provisional Patent Application, Ser. No. 60/090897, entitled "Impulse Antenna," filed on Jun. 25, 1998 by inventors Rosenbury et al.

The United States Government has rights in this invention pursuant to Contract No. W-7405-ENG-48 between the United States Department of Energy and the University of California for the operation of Lawrence Livermore National Laboratory.

BACKGROUND OF THE INVENTION

1. Field of the Invention

The present invention relates generally to antennas, and more particularly a class of low cost impulse compatible wideband antennas.

2. Discussion of Background Art

Radio frequency (RF) energy, also known as electromagnetic radiation (EMR), is an electromagnetic wave that propagates through circuits and under the right circumstances, through free space. Antennas are a critical part of many products and systems for transmitting and receiving free-space RF. Antennas are used to efficiently convert energy from a circuit or transmission line (wires) to free space.

Wide bandwidth antennas are a special sub-class of antennas that can transmit over a wide range of frequencies. Presently, new technologies are being developed using Micro-Impulse Radar (MIR). MIR based devices are useful for inspecting highways and bridges, underground object detection, and behind walls. MIR can also be useful for communications, and other microwave sensor operations, such as that described in U.S. Pat. No. 5,361,070, entitled "Ultra Wideband Radar Motion Sensor," issued on Nov. 1, 1994 by inventor Thomas E. McEwan.

Standard wideband antennas have a horn design and require machined tolerances, which are difficult to make and often have a low yield. As a result, over thirty percent of the cost of a typical radar systems is for its antenna and catalog broadband antennas typically cost into the several thousands of dollars.

MIR signals however, not only contain frequencies across a broad range, but often have a large low frequency (and even DC) components that easily reflect back into the microwave system causing ringing and feedback noise. Many standard antennas are particularly susceptible to reflections due to impedance mismatching. Pulse dispersion (the tendency to radiate different frequencies from different portions of the antenna) is also a problem with standard wideband antennas. Thus, antennas which transmit MIR signals, also known as Impulse Antennas, must be very wideband, compatible with impulses and be closely impedance matched over the broad frequency ranges of impulse systems, such as MIR.

Furthermore, there is a growing need for both broadbeam and narrowbeam antennas in the RF/microwave spectrum.

In response to the concerns discussed above, what is needed is a low cost wideband antenna that overcomes the shortcomings of the prior art.

SUMMARY OF THE INVENTION

The present invention is a low cost impulse compatible wideband antenna. The antenna may be used for either transmission or reception. Within the system of the present invention, impulse signals travel through a feed point with respect to a ground plane. A geometric fin structure is connected to the feed point, and through a termination resistance to the ground plane. A geometric ridge structure connected to the ground is positioned with respect to the fin in order to receive and radiate electromagnetic energy from the impulse signal at a predetermined impedance and over a predetermined set of frequencies. The fin and ridge can be either a wire or a planar surface.

In another aspect of the invention, the fin and ridge are disposed within a radiation cavity if further direction of the electromagnetic energy is desired. Sidewalls of the cavity may be of various shapes, lengths, and angles with respect to the fin and the ridge.

Within the method of building the present invention, the radiation cavity is constructed of stamped and/or etched metal sheets bent and then soldered together. The fin and ridge are also formed from metal sheets or wires. The fin is attached to the feed point and then to the cavity through a termination resistance. The ridge is attached to the cavity and disposed with respect to the fin in order to achieve a particular set of antenna characteristics.

These and other aspects of the invention will be recognized by those skilled in the art upon review of the detailed description, drawings, and claims set forth below.

DETAILED DESCRIPTION OF THE PREFERRED EMBODIMENT

Antennas have reciprocal properties, meaning that if energy propagates out of an antenna with a certain beam shape and efficiency, then it can also receive energy with precisely the same beam pattern and efficiency. Thus, the structures, acts and materials discussed in this specification in context of either transmission or reception, apply to both uses of the antenna.

Figure 1:
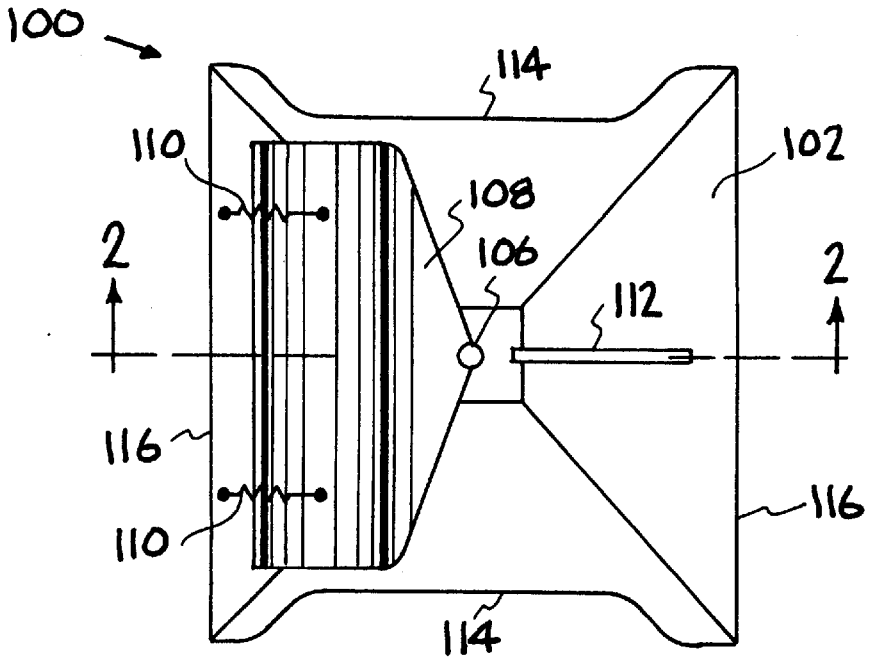
FIG. 1 is an aperture view of a first exemplary embodiment of a low cost impulse compatible wideband antenna.
Figure 2:
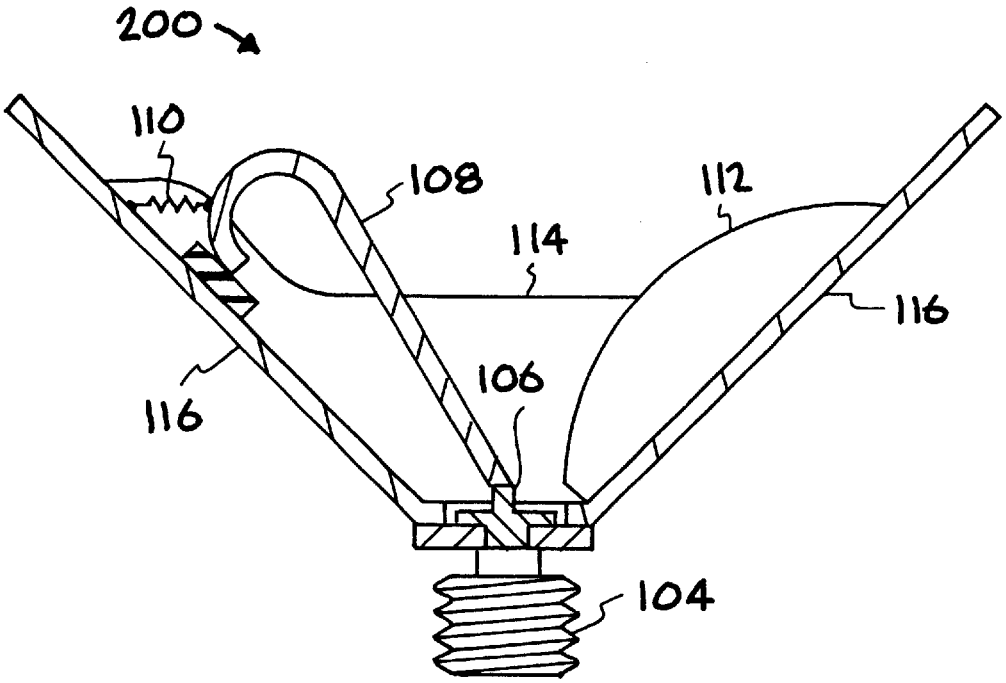
FIG. 2 is a cross-sectional view of the first exemplary antenna.

FIG. 1 is an aperture view of a first exemplary embodiment of a low cost impulse compatible wideband antenna 100. FIG. 2 is a cross-sectional view 200 of the first exemplary antenna 100. The first antenna 100 includes a radiation cavity 102, a connector 104, a feed point 106, a fin 108, a termination resistance 110, and a ridge 112.

The radiation cavity 102 is of a horn-type configuration for mounting the other antenna components (104 through 110), directing RF energy into free-space, and providing a return path to ground for any remaining unradiated energy. The cavity 102 is formed from upper and lower sidewalls 114 and left and right sidewalls 116. Together these sidewalls form an aperture from which RF energy radiates. Those skilled in the art will recognize that the sidewalls 114 and 116 can be varied in length, changed in angle with respect to the fin 108 and ridge 112, or removed entirely depending upon an antenna pattern desired. An aperture of the antenna 100 formed by the sidewalls 114 and 116 can have a variety of trapezoidal configurations, including box shapes and curved shapes. In order to minimize cost, the cavity 102 is formed from etched and/or stamped parts which are then bent and soldered into place. These parts 102, 108, and 112 are often formed from brass which permits easier manufacture, however, parts 102, 108, and 112 can also be made of many other conducting materials (e.g. aluminum, steel, copper, etc.).

The connector 104 has an exterior conductor insulated from a center conductor and can be in a form of an SMA, N-Type, or several other well know types of connectors. The exterior conductor is physically and electrically connected to the cavity 102, forming an electrical ground plane. The center conductor is connected to the feed point 106. Impulse, and or other, signals to be transmitted or received are electrically applied across the exterior conductor and center conductor. In one embodiment of the invention the connector 104 is a 50 ohm female (SMA) coax connector, although, other (non-coax) connectors may also be used.

The fin 108 is a geometric structure coupled to the feed point, having, a planar fin surface, defined by a fin length and a fin width. The fin 108 also has a fin thickness. The fin thickness is less than the fin length and the fin width. Alternatively, the fin 108 can be constructed from a single wire or a set of wires. The fin 108 shown is tapered to a point where the fin 108 is connected to the feed point 106, and broadens out toward the aperture of the antenna 100. The feed point is defined as a point where an external circuit or transmission line penetrates the antenna structure providing RF energy ready to be converted into free space propagation. The fin 108 also curves toward one of the sidewalls 116 of the radiation cavity 102. The fin 108 is attached to the sidewall 116 by the termination resistance 110. Transmitted RF energy propagates from the feed point toward the termination 110. At a predetermined distance from the feed point 106, conditions become such that the RF energy becomes unconstrained by the fin 108. This predetermined distance where RF energy leaves an antenna is also called a launch point and is a function of each wavelength (or photon) of RF energy. For each wavelength's launch point there is defined a theoretically equivalent "phase center." Depending upon a set of desired antenna characteristics, the fin 108 can be lengthened for more efficient low frequency operation, or shortened for more efficient high frequency operation. The fin 108 may also be filled or coated on one or both sides with dielectric materials. Preferably, the fin 108 is positioned as far away from the sidewalls 114 and 116 of the cavity 102 as possible in order to minimize electromagnetic field (EMF) strength between the fin 108 and the cavity 102.

The termination resistance 110 absorbs any RF energy remaining at the end of the fin 108 during transmission. The termination resistance 110 is most commonly a resistor or a set of resistors matched to an impedance, typically 50 ohms, of a transmission line (not shown) feeding the antenna 100. The terminating resistance 110 can alternatively be formed from a resistive tape and/or a resistive epoxy. Lossy dielectrics or lossy magnetic materials may also be effective. The termination resistance 110 serves to remove low frequency (including DC) energy from transmitted and/or received signals in order to prevent "ringing." Ringing problems have been a major limitation in existing impulse antennas, since impulse signals often produce step functions or single direction impulses. In addition to impulse signals, the antenna 100 is also compatible with continuous wave (cm), impulse (short voltage spikes), and fast-edge step functions. In alternate embodiments of the antenna 100, the termination resistance 110 may be eliminated and the fin 108 either electrically connected to or left unconnected from the radiation cavity 102. These alternate embodiments, however, may limit which signals can be effectively transmitted from the antenna 100.

The ridge 112 is a geometric structure coupled to the electrical ground plane, which in the present embodiment is the cavity 102. The ridge 112 has a planar ridge surface, defined by a ridge length and a ridge width. The ridge 112 also has a ridge thickness. The ridge thickness is less than the ridge length and the ridge width. The ridge 112 broadbands and impedance matches the antenna 100. Broadbanding an antenna reduces internal resonances and allows the antenna to efficiently propagate RF energy over a broad RF bandwidth. The ridge 112 shown is a gentle arc extending from near the feed point 106 toward the aperture of the antenna 100. Those skilled in the art however will also recognize that the ridge 112 may be shaped in a variety of configurations, depending upon a desired antenna pattern and set of impedance characteristics. The ridge 112 in a preferred positions is directly opposed to the fin 108.

Antenna impedance is a very important factor in antenna design. VSWR, SWR, S11 and reflection coefficient are all different representations of antenna impedance. Impedance of the antenna 100 is a function of each point along the antenna's length, from the feed point 106 to the aperture. Impedance is defined as a ratio of an electric field to a magnetic field at each point in the antenna. The geometric distances from the fin to the ground plane defines the antenna impedance along the fin. The antenna 100 impedance characteristics can be modified by adjusting a shape of the fin 108 and the ridge 112 with respect to each other. Thus, although any two antennas may look substantially different they may still share a common impedance characteristic. In the present invention, the fin and ridge shape and positioning are derived through either modeling or empirical methods so as to match a line impedance, typically 50 ohms, of the transmission line feeding the antenna 100, mentioned above.

During antenna 100 operation, electric field lines radiate from the fin 108 to the electrical ground plane. In the embodiment shown, the electrical ground plane consists of the radiation cavity 102, the ridge 112, and the external housing of the connector 104. A large electromagnetic flux density is preferred between the fin 108 and the ridge 112 in order to most effectively propagate RF waves during transmission and enable detection of RF waves during reception. In contrast, a smaller electromagnetic flux density is preferred between the fin 108 to the sidewalls 114 and 116 in order to minimize reflections, self canceling fields, and internal resonances. While ultimately, a final shape of the fin 108 and ridge 112 with respect to the cavity 102 is identified through trial and error testing, several common tuning methods are available including, modeling, CW-VSWR measurement, "cut and try," and so on.

One of the simplest tuning methods is performed using a time domain reflectometer (TDR) according to the following steps:

1) Set a TDR span to start at the feed point and end just past the aperture (e.g., if the antenna is to be 8"–10" long, set 0 ns at the feed point and 1 ns at the aperture).
2) Assuming a pre-assembled horn with a tapered ridge, start with an oversized fin, which barely fits in the horn. Connect the fin to the feed point and the resistive termination leaving a small gap between the fin and the ridge at the feed point. A continuous gap between the fin 108 and the ridge 112 must however be maintained in order to prevent grounding of the fin to the electrical ground plane.
3) Measure impedance (or VSWR) with the TDR. The fin should be capacitive (as opposed to inductive) at the feed point end.
4) Remove the fin and trim until the impedance matches a desired impedance.
5) Continue steps 3 and 4 while moving toward the aperture until an entire length of the antenna is matched. Assuming the horn shape and ridge shape were chosen reasonably, the antenna will now be complete.

Each element of the antenna 100 may be inexpensively manufactured using common stamped metal, etching, and soldering techniques. Each antenna 100 may then be easily assembled by fabrication technicians or through assembly line processes, in contrast to current antenna fabrication practices requiring close tolerance machining.

Figure 3:
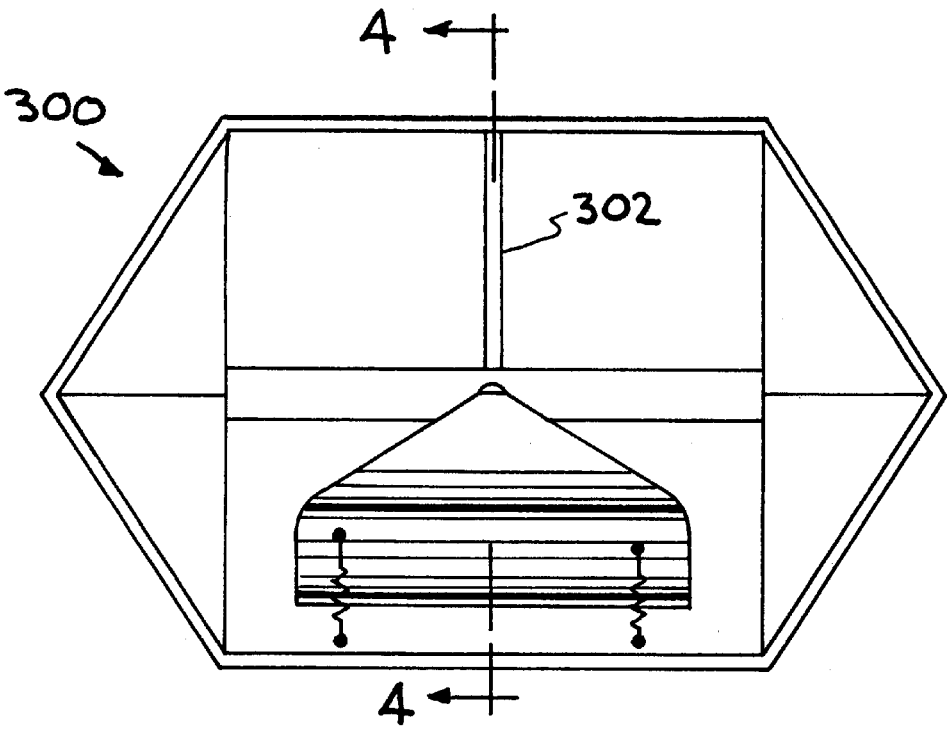
FIG. 3 is an aperture view of a second exemplary embodiment of a low cost impulse compatible wideband antenna.
Figure 4:
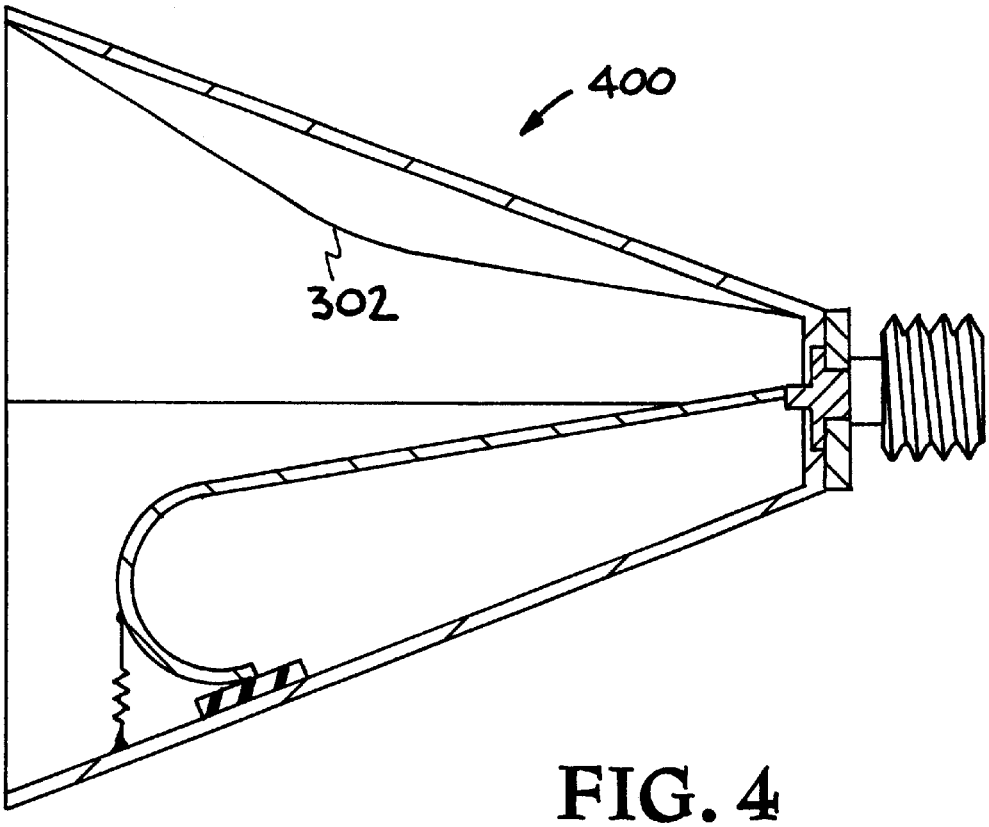
FIG. 4 is a cross-sectional view of the second exemplary antenna.

FIG. 3 is an aperture view of a second exemplary embodiment of a low cost impulse compatible wideband antenna 300. FIG. 4 is a cross-sectional view 400 of the second exemplary antenna 300. In contrast to a relatively rectangular shape of the first antenna 100, an aperture of the second antenna 300 has a more trapezoidal shape. In addition, a ridge 302 of the second antenna 300 has a shallower arc when compared to the ridge 112 of the first antenna 100. Such design modification result is a different set of impedance, beamwidth, and bandwidth characteristics.

Figure 5:
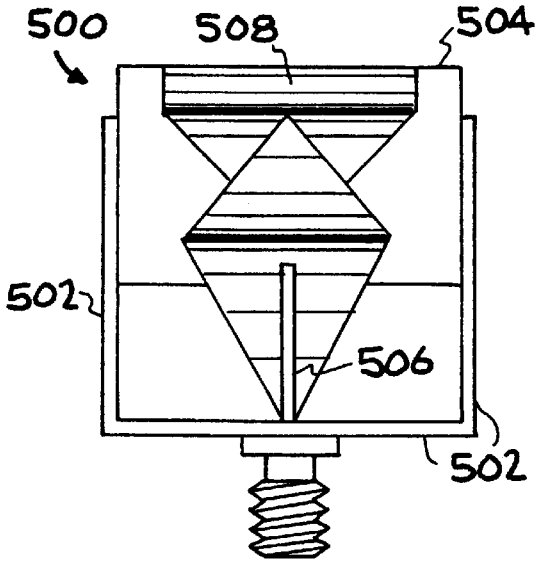
FIG. 5 is an aperture view of a third exemplary embodiment of a low cost impulse compatible wideband antenna.
Figure 6:
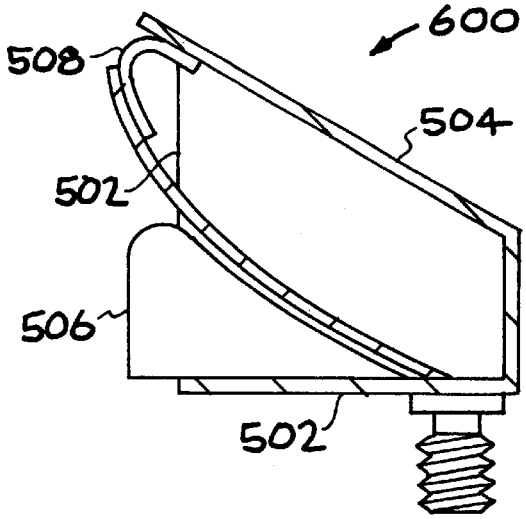
FIG. 6 is a cross-sectional view of the third exemplary antenna.

FIG. 5 is an aperture view of a third exemplary embodiment of a low cost impulse compatible wideband antenna 500. FIG. 6 is a cross-sectional view 600 of the third exemplary antenna 500. In contrast to the horn shaped cavity 102 of the first antenna 100, an aperture of the third antenna 500 has a combination box-horn shape. This box-horn shape includes three flat perpendicular sidewalls 502 and one angled sidewall 504. In addition, a ridge 506 of the third antenna 500 also has a different cross-section when compared to the first antenna 100. In the third antenna 500, a termination resistance 508 is in a form of a resistive band, in contrast to the discrete termination resistance 110 of the first antenna 100.

Figure 7:
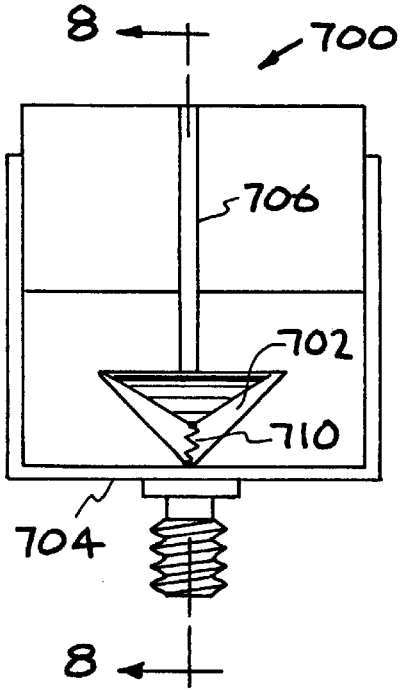
FIG. 7 is an aperture view of a fourth exemplary embodiment of a low cost impulse compatible wideband antenna.
Figure 8:
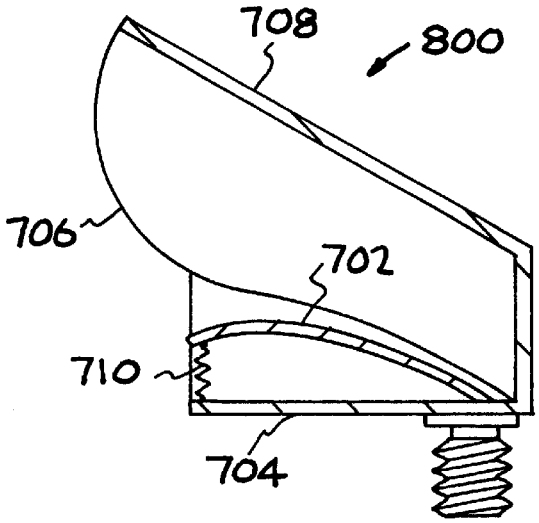
FIG. 8 is a cross-sectional view of the fourth exemplary antenna.

FIG. 7 is an aperture view of a fourth exemplary embodiment of a low cost impulse compatible wideband antenna 700. FIG. 8 is a cross-sectional view 800 of the fourth exemplary antenna 700. In contrast to the third antenna 500, which has a fin connected to the angled sidewall 504 and a ridge connected to one of the perpendicular sidewalls 502, the fourth antenna 700 has a fin 702 connected to a perpendicular sidewall 704 and a ridge 706 connected to an angled sidewall 708. Also, the resistive band of the third antenna 500 has been replaced by a discrete termination resistor 710.

Figure 9:
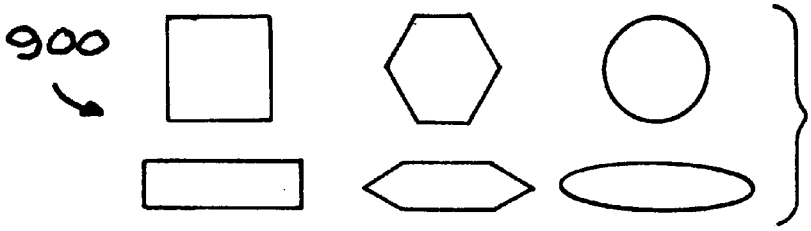
FIG. 9 is an aperture view of alternate exemplary cavities.

FIG. 9 is an aperture view of alternate exemplary cavities 900. While six exemplary cavities 900 are shown in either a square, octagonal, circular, rectangular, trapezoidal, and oval configuration, those skilled in the art will recognize that many other regular or irregular geometric shapes may be used depending upon a desired antenna radiation pattern and/or impedance.

Figure 10:
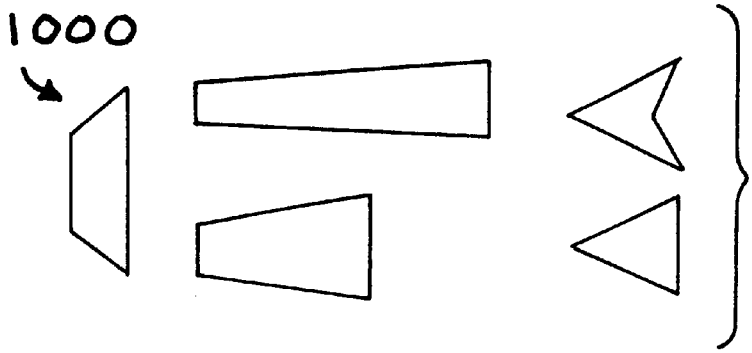
FIG. 10 is a cross-sectional view of alternate exemplary cavities.

FIG. 10 is a cross-sectional view of alternate exemplary cavities 1000. While five exemplary cavities 1000 are shown in various trapezoidal configurations, those skilled in the art will recognize that many other regular or irregular geometric shapes may be used depending upon a desired antenna radiation pattern and/or impedance.

Figure 11:
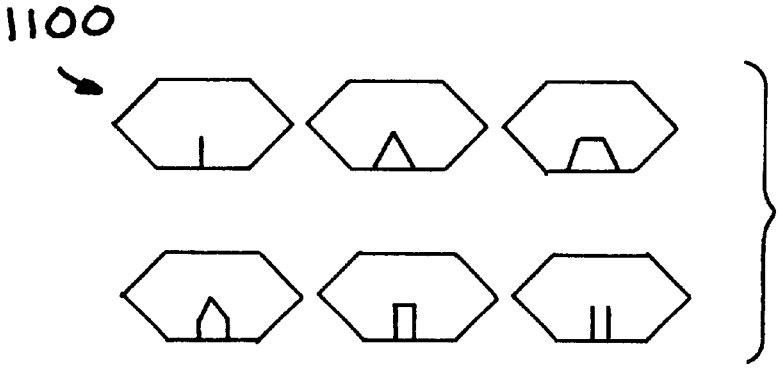
FIG. 11 is an aperture view of alternate exemplary ridges.

FIG. 11 is an aperture view of alternate exemplary ridges 1100. While six exemplary ridges 1100 are shown as either one or more lines, and various trapezoidal configurations, those skilled in the art will recognize that many other regular or irregular geometric shapes may be used depending upon a desired antenna radiation pattern and/or impedance.

Figure 12:
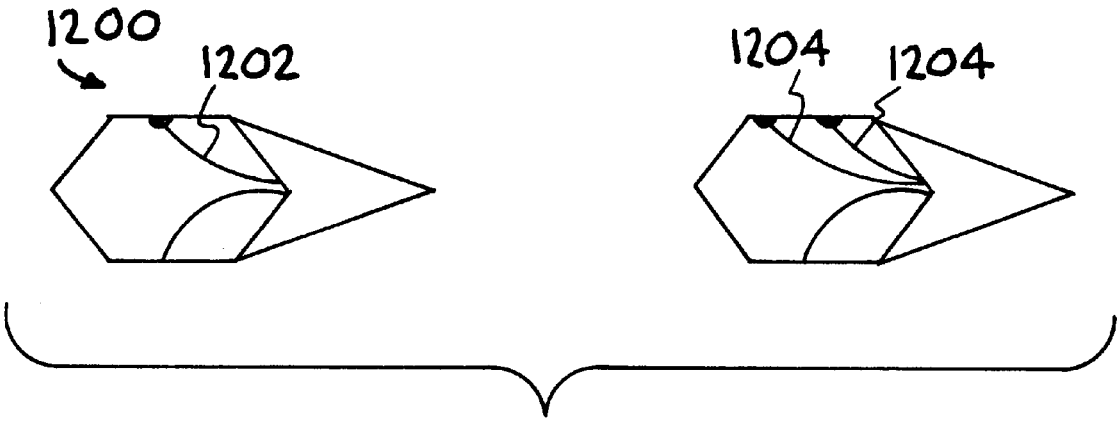
FIG. 12 is an aperture view of alternate exemplary fins.

FIG. 12 is an aperture view of alternate exemplary fins 1200. While fins are often in the form of conductive sheets of stamped metal, they can also be constructed from one 1202 or more wires 1204.

While the present invention has been described with reference to a preferred embodiment, those skilled in the art will recognize that various modifications may be made. Variations upon and modifications to the preferred embodiment are provided by the present invention, which is limited only by the following claims.

What is claimed is:

1. An antenna apparatus comprising:

a feed point;

a ground;

a geometric fin structure coupled to the feed point and spaced away from said ground;

only one geometric ridge structure coupled to the ground; and a connector having an external housing coupled to the ground and a center conductor coupled to the feed point.

2. The apparatus of claim 1, wherein the geometric fin structure is a wire.

3. The apparatus of claim 1, wherein the geometric fin structure has a planar fin surface.

4. The apparatus of claim 3, wherein the geometric ridge structure has a planar ridge surface positioned approximately perpendicular to the planar fin surface.

5. The apparatus of claim 1, wherein the antenna apparatus has a preselected impedance between the feed point and the ground.

6. The apparatus of claim 1, wherein the connector is a 50 ohm connector.

7. The apparatus of claim 1, further including a radiation cavity coupled to the ground.

8. The apparatus of claim 7, wherein the radiation cavity includes a set of sidewalls each having predetermined heights and positioned at predetermined angles with respect to each other.

9. The apparatus of claim 7, wherein the radiation cavity is a horn structure.

10. The apparatus of claim 7, wherein the radiation cavity is a box structure.

11. The apparatus of claim 7, wherein at a predetermined distance from the feed point a first distance between the geometric ridge structure and the geometric fin structure is less than a second between the geometric fin structure and the cavity.

12. The apparatus of claim 1, further comprising an impulse signal coupling the feed point to the ground.

13. The apparatus of claim 1, further comprising a termination resistance, coupled between the geometric fin structure and the ground.

14. A method for building an antenna, comprising the steps of:

constructing a radiation cavity having a feed point;

coupling a geometric fin structure which is spaced away from said radiation cavity to the feed point; and coupling only one geometric ridge structure to the cavity.

15. The method of claim 14 wherein the constructing a radiation cavity step includes the steps of:

stamping a metal sheet into a predetermined shape;

etching the metal sheet;

bending the metal sheet into a shape of the radiation cavity; and soldering seams of the radiation cavity.

16. The method of claim 14 wherein the coupling of a geometric fin structure step includes the step of:

constructing the geometric fin structure from a wire filament.

17. The method of claim 14 wherein the coupling of a geometric fin structure step includes the step of:

forming the geometric fin structure as a shaped metal sheet.

18. The method of claim 14 wherein the coupling of a geometric ridge structure step includes the steps of:

forming the geometric ridge structure as a shaped metal sheet.

19. The method of claim 14 further including the step of:

coupling a termination resistance between the geometric fin structure and the cavity.

20. An antenna apparatus comprising:

a feed point;

a ground;

a geometric fin structure coupled to the feed point and spaced away from said ground;

only one geometric ridge structure coupled to the ground; and a radiation cavity coupled to the ground.

21. The apparatus of claim 20, wherein the radiation cavity includes a set of sidewalls each having predetermined heights and positioned at predetermined angles with respect to each other.

22. The apparatus of claim 20, wherein the radiation cavity is a horn structure.

23. The apparatus of claim 20, wherein the radiation cavity is a box structure.

24. The apparatus of claim 20, wherein at a predetermined distance from the feed point a first distance between the ridge and the fin is less than a second distance between the fin and the cavity.

25. An antenna apparatus comprising:

a feed point;

a ground;

a geometric fin structure coupled to the feed point and spaced away from said ground; and only one geometric ridge structure coupled to the ground; and a termination resistance coupled between the fin and the ground.

* * * * *